United States Patent [19]

Eisenberg

[11] Patent Number: 5,058,209

[45] Date of Patent: Oct. 22, 1991

[54] GLOVE FOR PROTECTING THE ULNAR COLLATERAL LIGAMENT

[76] Inventor: Joel H. Eisenberg, 410 Morehouse Rd., Easton, Conn. 06612

[21] Appl. No.: 512,854

[22] Filed: Apr. 23, 1990

Related U.S. Application Data

[63] Continuation of Ser. No. 145,621, Jan. 19, 1988, which is a continuation of Ser. No. 727,815, Apr. 26, 1985.

[51] Int. Cl.[5] ..... A41D 19/00

[52] U.S. Cl. ..... 2/161 A; 2/16; 2/18; 2/19; 2/159

[58] Field of Search ..... 2/16, 18, 19, 20, 158, 2/159, 160, 161 A, 161 R, 163; 128/87 A

[56] References Cited

U.S. PATENT DOCUMENTS

| | | | |
|---|---|---|---|
| 461,819 | 10/1891 | Draper | 2/19 |
| 877,561 | 1/1908 | Goldsmith | 2/19 |
| 1,545,998 | 7/1925 | Barrett | 2/19 |
| 1,567,658 | 12/1925 | Latina | 2/19 |
| 2,056,326 | 10/1936 | Orsini | 2/18 |
| 2,231,204 | 2/1941 | Turner | 2/163 |
| 2,288,467 | 6/1942 | Latina | 2/19 |
| 2,416,444 | 2/1947 | Hilton | 2/18 |
| 2,459,887 | 1/1949 | Latina | 2/19 |
| 2,473,025 | 6/1949 | Gregg | 2/19 |
| 2,681,448 | 6/1954 | Tompkins | 2/19 |
| 2,751,598 | 6/1956 | Romeo | 2/161 A |
| 2,928,102 | 3/1960 | Canausa | 2/161 A |
| 3,169,250 | 2/1965 | Heiman | 2/19 |
| 3,707,730 | 1/1973 | Slider | 2/161 A |
| 4,438,532 | 3/1984 | Campanella | 2/16 |
| 4,445,507 | 5/1984 | Eisenberg | 2/159 |
| 4,524,464 | 6/1985 | Primiano | 2/161 A |
| 4,565,195 | 1/1986 | Eisenberg | 2/161 A |

FOREIGN PATENT DOCUMENTS

| | | | |
|---|---|---|---|
| 3600993 | 10/1986 | Fed. Rep. of Germany | 2/16 |
| 292339 | 6/1928 | United Kingdom | 2/20 |
| 490786 | 8/1938 | United Kingdom | 2/159 |

*Primary Examiner*—Werner H. Schroeder
*Assistant Examiner*—Diana L. Biefeld
*Attorney, Agent, or Firm*—Fish & Richardson

[57] ABSTRACT

A glove having the thumb pocket connected to the finger portion so as to restrict movement of the thumb portion away from the rest of the glove thereby preventing damage to certain ligaments of the user's thumb should the thumb be bent abnormally.

1 Claim, 1 Drawing Sheet

GLOVE FOR PROTECTING THE ULNAR COLLATERAL LIGAMENT

This is a continuation of co-pending application Ser. No. 145,621 filed on Jan. 19, 1988 which is a continuation of Ser. No. 727,815 filed Apr. 26, 1985.

FIELD OF THE INVENTION

This invention relates to the field of protective handwear, particularly in regard to preventing damage to certain ligaments of the thumb.

BACKGROUND OF THE INVENTION

In various sports and recreational activities, as well as in industry, there are numerous occasions when, as a result of a fall or other event, the thumb is momentarily bent away from the other fingers of the hand. This bending results in a stretching of the ulnar collateral ligament which is connected around the thumb's lower joint, the metacarpal phalangeal joint. If this stretching is severe enough, the ligament will rupture, and as it will frequently not heal by itself, surgery is often required to repair the tear. Even if the ligament is not torn, such a stretching, particularly if repeated, will loosen the ligament giving rise to a chronic wobbling of the joint, which could cause arthritis.

Prior art gloves and handwear are, at best, only designed to protect the hand from cold or from abrasions and do not prevent such ligament damage at all. Furthermore, the common way to protect the thumb area after surgery is by using a cumbersome cast, which cannot, as a practical matter, be kept on the hand for longer than six to eight weeks, a time period far short of that actually required for the ligament to mature.

In my earlier glove inventions, covered by my U.S. Pat. No. 4,445,507 issued May 1, 1984, and my U.S. patent application Ser. No. 604,506, filed Apr. 27, 1984 both incorporated herein by reference, a restraint on the outside (radial side) of the thumb was used to prevent such ligament damage.

SUMMARY OF THE INVENTION

I have discovered that stress on the ulnar collateral ligament can be greatly reduced while allowing the thumb and hand generally normal freedom of movement by effectively connecting and maintaining the thumb against the second metacarpal or index finger.

In a preferred embodiment, a thumb pocket for a glove is connected by a drawstring to the remainder of the glove. In use, the drawstring is pulled tight so that the thumb pocket is adjacent to and held against the remaining portion of the glove so that a fall cannot bend the thumb pocket and thumb away from the other fingers.

In another embodiment, the thumb pocket is stitched along its length to the remainder of the glove, while in a third embodiment, the glove is made without a separate thumb pocket. A fourth embodiment has a thumb pocket that encompasses not only the thumb but the index finger as well.

In each case, the gloves of this invention present any severe radial movement of the thumb, which could rupture or damage the ulnar collateral ligament. At the same time, the users hand can still grasp objects such as ski poles.

DESCRIPTION OF THE PREFERRED EMBODIMENTS

Drawings

I turn now to the description of the preferred embodiment, after first briefly describing the the drawings.

Structure

Figure 1:
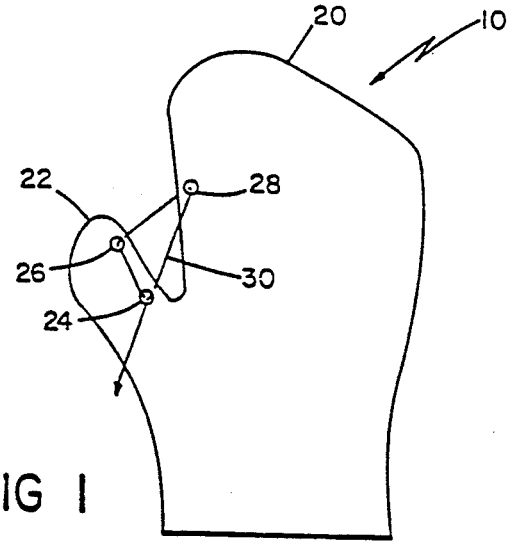
FIG. 1 is a view of the glove of the preferred embodiment of the invention with a drawstring still open.

Referring to FIG. 1, a glove according to the invention herein is shown at 10. The glove 10 has a finger portion 20 and a thumb pocket 22. (The glove shown is in the form of a mitten. However, it should be understood that the glove may also have separate pockets for each of the fingers.)

The thumb pocket 22 has a first hole 24 and a second hole 26. Additional holes may also be used. Hole 24 is disposed in the lower portion of the thumb pocket 22 towards its ulnar side (towards the fingers). The second hole 26 is also on the ulnar side of the thumb pocket 22, but it is located near the top of the thumb pocket 22. A third hole 28 is disposed on the radial side (towards the thumb) of the finger portion 20.

A drawstring 30 has one end attached at or about the first hole 24 in the thumb pocket 22. The drawstring 30 is then fed first through the second hole 26 and then through the third hole 28. The drawstring is then threaded back through the first hole 24. In operation, the glove 10 is placed on the user's hand in the usual manner. The thumb (not shown) fits into the thumb pocket 22 and the other fingers fit into the finger portion 20. Once on, the drawstring 30 is pulled downward in the direction indicated by the arrow. This forces the ulnar side of the thumb pocket 22 and the thumb up against the radial side of the finger portion 20. The drawstring is then tied in place, thereby securing thumb pocket 22 to the finger portion 20. So secured, the thumb cannot be bent radially away from the fingers causing damage to the ulnar collateral ligament.

Figure 5:
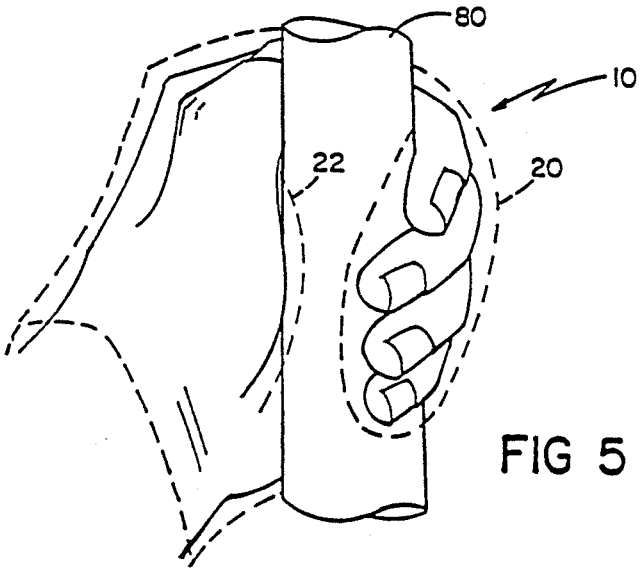
FIG. 5 is a perspective side of the glove of the preferred embodiment showing the hand inside when in use.

The glove 10 is shown in use in FIG. 5. The thumb pocket 22 is attached to the finger portion 20, but a ski pole 80 can be grasped by the user. In this case, the thumb curls around the pole 80 with the other fingers instead of grasping the pole 80 in the opposite direction as the fingers, as is usual.

Figure 2:
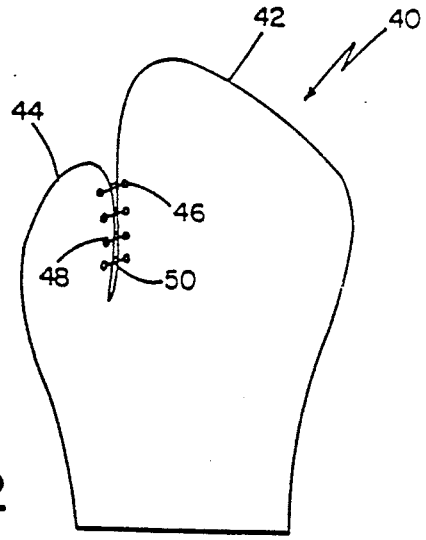
FIG. 2 is a view of the second embodiment of the invention.

A second embodiment of the invention is shown in FIG. 2. A glove 40 according to the invention again comprises a finger portion 42 and a thumb pocket 44. A series of holes 46 (only four shown) extend along the lower half of the radial side of the finger portion 42. A similar set of holes 48 (only four shown) extend up the ulnar side of the thumb pocket 44. A cord 50 is effectively stitched through the sets of holes 46, 48 to secure the thumb pocket 44 to the remainder of the glove.

Figure 3:
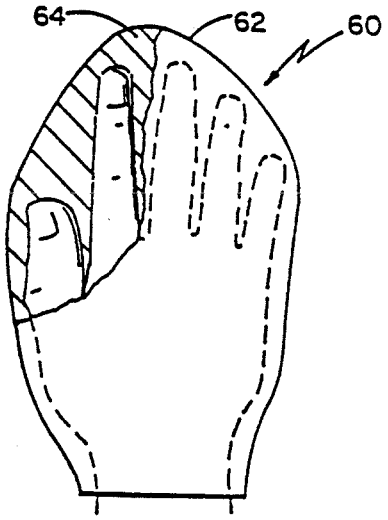
FIG. 3 is a view of a third embodiment of the invention with a portion cut away.

A third embodiment of the invention is shown in FIG. 3. A glove 60 according to the invention is comprised of a single pocket 62 into which the thumb and all the fingers fit. Insulation 64 surrounds the thumb and fingers. As with the previous embodiments, the thumb cannot be bent radially away from the fingers so as to damage the ulnar collateral ligament.

Figure 4:
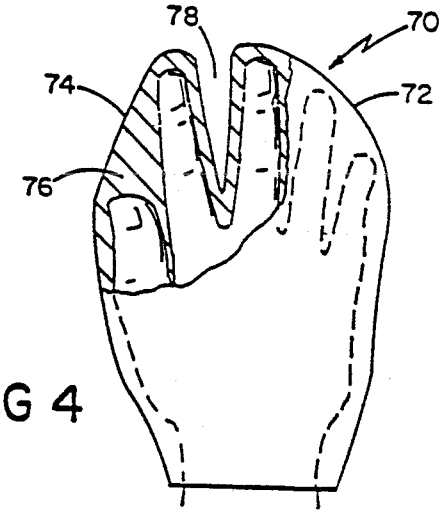
FIG. 4 is a view of a fourth embodiment with a portion cut away.

A fourth embodiment of the invention is shown in FIG. 4. A glove 70 of this embodiment is composed of a first pocket 72 and a second pocket 74, separated by an opening 78. When in use, the first pocket 72 contains three fingers while the second pocket 74 contains the thumb and forefinger. Insulation 76 is provided in the second pocket 74, as shown. In operation, strain on the ulnar collateral ligament of the thumb is avoided because the thumb cannot bend radially away from index finger.

Other variations will occur to those skilled in the art.

What I claim is:

1. A protective glove for preventing injury to the thumb's ulnar collateral ligament comprising:

a hand covering having a first pocket and a second pocket, said first pocket adapted to receive the thumb and at least the forefinger of the hand and said second pocket adapted to receive the remaining fingers, whereby during use, radial movement of the thumb away from the remaining fingers, which movement might injure the ulnar collateral ligament of the thumb, is prevented.

* * * * *